United States Patent [19]

Cintron

[11] 4,041,741

[45] Aug. 16, 1977

[54] AUTOMOBILE TRUNK GUARD

[76] Inventor: Carlos U. Cintron, 8012 Bainbridge Road, Alexandria, Va. 22308

[21] Appl. No.: 645,926

[22] Filed: Dec. 31, 1975

[51] Int. Cl.[2] ..... E05B 63/00

[52] U.S. Cl. ..... 70/417; 70/DIG. 43

[58] Field of Search ..... 70/416, 429, 333, DIG. 43, 70/DIG. 36, 450, 452, 455

[56] References Cited

U.S. PATENT DOCUMENTS 3,768,284 10/1973 Kent ..... 70/417

FOREIGN PATENT DOCUMENTS 799,147 11/1968 Canada ..... 70/452

*Primary Examiner*—Robert L. Wolfe

*Attorney, Agent, or Firm*—Witherspoon, Lane & Hargest

[57] ABSTRACT

Protective plates for protecting against two common methods of breaking and entering an automobile trunk are disclosed. One plate is mounted on the outside of the trunk lid and the other plate is mounted on the inside of the trunk lid. The plate mounted on the outside of the trunk lid protects the trunk lid in the immediate area of the trunk lock. The plate mounted on the inside of the trunk lid protects against forceable removal of the lock cylinder. The plate that is mounted on the outside of the trunk lid surrounds the trunk lock and has a central opening to permit access to the trunk lock. Two threaded studs secured to this outside plate pass through holes drilled in the trunk lid and through holes provided in the plate that is mounted on the inside of the trunk lid. The plate mounted on the inside of the trunk lid has a central opening and is slipped over the trunk lock cylinder and over the two studs of the outside mounted plate. The two plates are then secured together by means of nuts that are threaded onto the studs of the outside plate. The plate mounted on the outside prevents one from manipulating the trunk latch by punching a hole in the trunk lid in the vicinity of the trunk lock and the inside mounted plate prevents one from gaining access to the trunk by the punching out of the lock cylinder.

2 Claims, 3 Drawing Figures

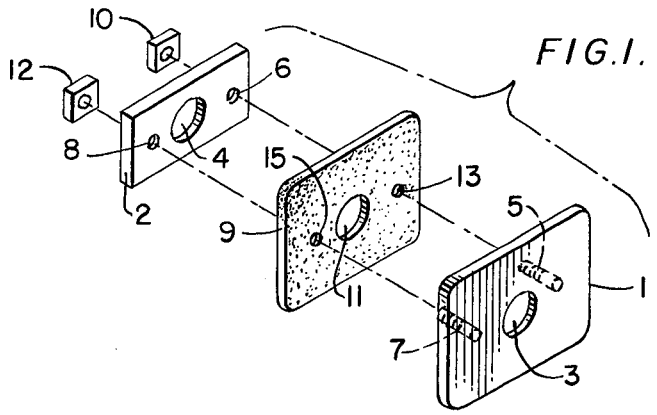
FIG.1.
FIG.2.
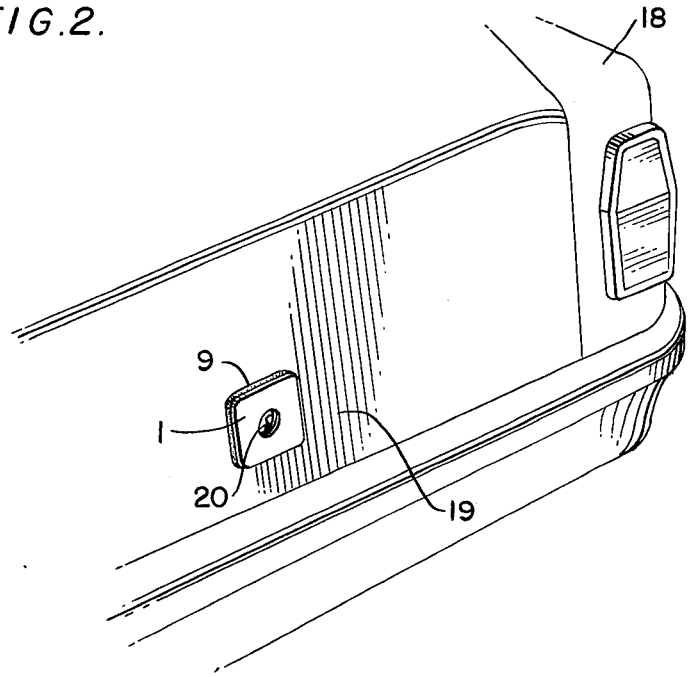
FIG.3.
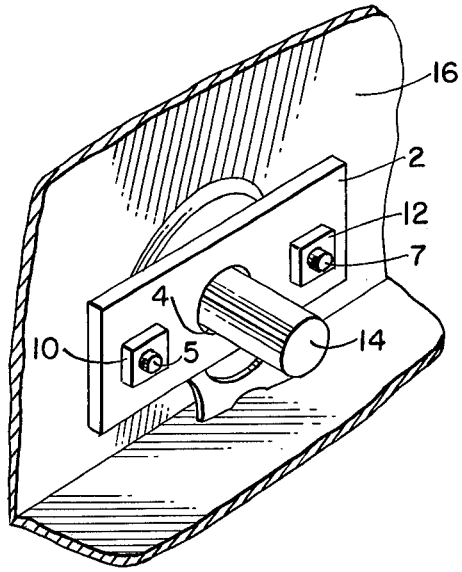

AUTOMOBILE TRUNK GUARD

BACKGROUND OF THE INVENTION

This invention relates to automobile trunk protective apparatus and, more particularly, to protective plates mounted on an automobile trunk lid to protect against the forceable entry of the trunk of an automobile.

Thefts of items stored in an automobile trunk have become a serious problem because generally automobile trunk lids can be forceably opened in a short period of time with minimum effort and skill. One method commonly used to gain access to an automobile trunk without a key involves punching a small hole in the trunk lid near the trunk lid lock. A sharp instrument such as an ice pick or the like is used to punch a hole in the trunk lid, usually just below the lock. The latch mechanism is then easily manipulated through this hole and the trunk lid is opened and the contents of the trunk are removed. The lid can then usually be closed again and the owner may not know for sometime that the items stored in his trunk have been stolen. A second method very often used to gain entry to an automobile trunk involves the forceable removal of the lock cylinder. This forceable removal of the lock cylinder is accomplished by punching the lock cylinder inward. One end of a tool is placed against the face of the lock and the other end of the tool is then struck by a heavy hammer to drive the entire lock cylinder into the trunk. When the cylinder is so removed, the trunk lid can be unlatched to gain access to the trunk.

This invention prevents one from punching a hole in the trunk lid in the vicinity of the trunk lock and also protects against the removal of the trunk lock cylinder.

SUMMARY OF THE INVENTION

The apparatus of this invention comprises two protective plates of relatively heavy gauge metal. One of the plates is mounted on the outside of an automobile trunk lid and the other plate is mounted on the inside of the trunk lid. The plate mounted on the outside of the trunk lid has two threaded studs secured to its back surface and has a circular opening cut generally through the center of the plate. The plate that is mounted on the inside of the trunk lid also has a circular opening cut generally in the center of the plate and has a smaller circular opening on each side of the centrally located circular opening.

Two holes, one located on one side of the trunk lock and the other located on the side of the trunk lock generally opposite the one hole, are drilled through the trunk lid. The holes in the trunk lid are so located and positioned that the studs on the back of the outside mounted plate will slip through the holes in the trunk lid with the centrally located opening surrounding the trunk lock. The centrally located hole has a diameter approximately equal to that of the diameter of the face of the trunk lock cylinder. By aligning the face of the trunk lock and the circular opening in the outside mounted plate, access to the trunk lock for operating the lock with its key is provided.

The inside mounted plate is positioned by slipping the lock cylinder through the centrally located opening in this plate and the plate is pushed up against the inside of the trunk lid. The holes cut on each side of the central opening of the inside mounted plate are so positioned that each hole mates with one of the threaded studs of the outside mounted plate. When both plates are in position with the studs of the outside mounted plate slipped through the mating hole of the inside plate, the two plates are secured together by means of nuts that are threaded onto the studs of the outside mounted plate.

With the outside plate in place, it is virtually impossible to merely punch a hole through the plate and through the trunk lid to gain access to the trunk latch mechanism. Of course, one could drill through the plate and the trunk lid with an electric drill; however, this would not be very practical since speed and ease of access are usually necessary if one is to break into an automobile trunk without being detected. Furthermore, even drilling can be made difficult by making the outside plate of a hardened steel.

The inside plate surrounds the lock cylinder and presses against the inside mounting ring or lip of the cylinder. The diameter of the centrally located hole of the inside plate is such that it just slips over the cylinder and presses against this ring or lip. Therefore, it is virtually impossible or at least extremely difficult to punch in the lock cylinder.

While the invention is designed primarily for use with an automobile trunk lid and is described in this environment, the invention has utility with any locked lid or door that is susceptible to being opened by punching a hole through the lid near the lock or by the punching in of the lock cylinder, metal cabinets or metal trunks made of relatively light gauge metal.

BRIEF DESCRIPTION OF THE DRAWING

A complete understanding of the invention can be obtained from the following detailed description when read in conjunction with the annexed drawing in which:

FIG. 1 shows a preferred embodiment of the protective plates of the invention;

FIG. 2 is a fragmentary view of an automobile showing the outside mounted plate of the invention; and FIG. 3 is a fragmentary view of the inside of an automobile trunk lid showing the inside mounted plate of the invention.

DETAILED DESCRIPTION OF THE INVENTION

Referring to the drawing, and particularly to FIG. 1, the apparatus of this invention comprises an outer plate 1 and an inner plate 2. Outer plate 1 is made of a relatively heavy gauge metal such as a hardened steel. Plate 1 has a hole 3 that is located generally in the center of the plate. A first threaded stud 5 and a second threaded stud 7 are secured to the rear face of plate 1 by welding or by any other suitable means.

Inner plate 2 is also made from a relatively heavy gauge metal such as a hardened steel. Inner plate 2 has a hole 4 generally located in the center of the plate. A small hole 6 is cut into plate 2 on one side of hole 4 and a small hole 8 is cut into plate 2 on the other side of hole 4. Holes 6 and 8 are of a sufficient diameter to permit studs 5 and 7 to pass through holes 6 and 8, respectively.

A washer or cushion plate 9 is provided with outer plate 1. Washer 9 is made from a resilient material such as rubber. A hole 11 is cut through generally the center of washer 9. A hole 13 is cut through washer 9 on one side of hole 11 and a hole 15 is cut through washer 9 on the other side of hole 11. As will become apparent, holes 13 and 15 are slipped over studs 5 and 7, respectively, and washer 9 is pressed against the inner face of plate 1. When washer 9 is so positioned, hole 3 of plate 1 and hole 4 of plate 9 are aligned. The diameter of hole 11 of washer 9 is essentially the same as the diameter of hole 3 of outside plate 1. A pair of nuts, the nuts 10 and 12, are provided. As will become apparent, nuts 10 and 12 are threaded onto studs 5 and 7, respectively.

Referring now to FIGS. 2 and 3, FIG. 2 shows a part of the rear of an automobile 18 having a trunk lid 19 and a trunk lid lock 20. FIG. 3 shows the inside 16 of trunk lid 19 and the cylinder 14 of trunk lock 20.

As is evident from FIGS. 2 and 3, outer plate 1 is mounted on the outside of trunk lid 19 and inner plate 2 is mounted on the inside 16 of trunk lid 19. Holes (not shown) of the appropriate size and properly located to accomodate studs 5 and 7 are drilled through trunk lid 19. Holes 13 and 15 of washer 9 are slipped over studs 5 and 7 and washer 9 is pushed up against the rear face of outer plate 1. Studs 5 and 7 of outer plate 1 are slipped through the holes drilled in trunk lid 19 and outer plate 1 is pushed up against the outside of trunk lid 19 with washer 9 positioned between the outer surface of trunk lid 19 and the inner face of outer plate 1. Hole 4 of inner plate 2 is slipped over cylinder 14 of trunk lid lock 20 on the inside 16 of trunk lid 19 and holes 6 and 8 of inner plate 2 are slipped over the studs 5 and 7 which protrude through the trunk lid 19 when outer plate 1 is in place. Nuts 10 and 12 are then each threaded onto one of the studs 5 and 7 and tightened by means of a wrench or the like.

With plate 1 in place and secured, the area of trunk lid 19 surrounding lock 20 is protected. Therefore, one cannot punch a hole in trunk lid 19 in the vicinity of lock 20 to manipulate the latch and open the trunk lid to gain access to the trunk. Similarly, with inner plate 2 in place and secured, one cannot readily, if at all, punch lock 20 inward and completely out of the trunk lid 19. Further, outer plate 1 prevents one from pulling lock 20 out of trunk lid 19.

While plate 1 and 2 have been described as being used with a trunk lid and lock mechanism of an automobile, it should be apparent that plates 1 and 2 can be used to protect other similar lids or doors such as the lids of light gauge metal trunks and the doors of light gauge metal cabinets. Also, while outer plate 1 has been shown as being generally square in shape and plain outer face, outer plate 1 can be fabricated to have any shape and the other face of plate 1 can have a design formed thereon such as, for example, an emblem associated with that make of automobile with which it is being used or some fancy scroll work or the like. In addition, plates 1 and 2 can be added to any new or used automobile at any time. Outer plate 1 will be shaped to fit flush on the outside of the automobile trunk lid. Thus, for each make of automobile, outer plate 1 will be curved or shaped to fit the contours of the trunk lid in that plate 1 fits flush against the outer surface of the trunk lid.

In addition to those changes and modifications specifically mentioned above, it will be obvious to those skilled in the art that various other changes and modifications can be made to the embodiment shown and described without departing from the spirit and scope of the invention as set forth in the claims.

What is claimed is:

1. Apparatus for protecting a trunk lid and trunk lock of an automobile to prevent forceable entry into the trunk of the automobile comprising:

a first protective plate made of a substantially heavy gauge metal, said first protective plate having a hole located substantially in the center thereof and having first and second threaded studs secured to one of its surfaces and projecting away from said surface, said first and second threaded studs being located on opposite sides of said hole and being spaced apart from said hole;

a resilient washer having substantially the same size and shape as said first protective plate and having a substantially centrally located hole of substantially the same diameter as said hole in said first protective plate, said resilient washer further having first and second holes located on opposite sides of said substantially centrally located hole of said resilient washer and spaced apart therefrom, said first and second holes in said resilient washer being located relative to said substantially centrally located hole in said resilient washer such that said first and second studs of said first protective plate will pass through said first and second holes of said resilient washer with said substantially centrally located hole of said resilient washer being aligned with said substantially centrally located hole in said first protective plate;

a second protective plate made of a substantially heavy gauge metal and having a substantially centrally located hole of sufficient diameter to permit said second protective plate to slip over the cylinder of said lock of said trunk lid and having first and second holes located on opposite sides of said substantially centrally located hole, said first and second holes in said second protective plate being so located relative to said substantially centrally located hole in said second protective plate that said first and second threaded studs will pass through said first and second holes of said second protective plate with the substantially centrally located hole in said second plate being substantially aligned with said substantially centrally located hole in said second plate when said first and second threaded studs are passed through said first and second holes in said second protective plate; and first and second nuts for securing said first protective plate to said second protective plate such that said first protective plate is located on the outside surface of said trunk lid and said second protective plate is located against the inside surface of said trunk lid with said cylinder of said lock of said trunk lid extending beyond said second protective plate into said trunk, said resilient washer being sandwiched between said outside surface of said trunk lid and said first protective plate, said first and second nuts being threaded onto said first and second threaded studs of said first protective plate.

2. The apparatus as defined in claim 1 wherein said hole located substantially in the center of said first protective plate is aligned with the face of said lock of said trunk lid such that said lock is accessible for unlocking by a key when said first protective plate is secured to said second protective plate.

* * * * *